US009108772B2

(12) United States Patent
Hovatter

(10) Patent No.: US 9,108,772 B2
(45) Date of Patent: Aug. 18, 2015

(54) CONTAINER LATCHING SYSTEMS FOR ONE-HANDED OPERATION

(71) Applicant: Scientific Specialties Inc., Lodi, CA (US)

(72) Inventor: Kenneth R. Hovatter, Lodi, CA (US)

(73) Assignee: Scientific Specialties, Inc., Lodi, CA (US)

( * ) Notice: Subject to any disclaimer, the term of this patent is extended or adjusted under 35 U.S.C. 154(b) by 0 days.

(21) Appl. No.: 13/839,055

(22) Filed: Mar. 15, 2013

(65) Prior Publication Data

US 2014/0271412 A1 Sep. 18, 2014

(51) Int. Cl.

| | |
|---|---|
| ***B01L 9/00*** | (2006.01) |
| ***B65D 43/22*** | (2006.01) |
| ***E05C 19/06*** | (2006.01) |
| ***B01L 3/00*** | (2006.01) |

(52) U.S. Cl.

CPC ..... *B65D 43/22* (2013.01); *B01L 3/508* (2013.01); *E05C 19/06* (2013.01); *B01L 2200/025* (2013.01); *B01L 2200/141* (2013.01); *B01L 2300/041* (2013.01); *Y10T 292/1043* (2015.04)

(58) Field of Classification Search

CPC ..... B65D 43/22; B01L 3/508
USPC ..... 422/561, 563, 564
See application file for complete search history.

(56) References Cited

U.S. PATENT DOCUMENTS

| | | | |
|---|---|---|---|
| 2,364,007 | A | 11/1944 | Stanton |
| 2,949,203 | A | 8/1960 | Berg |
| 2,992,501 | A | 7/1961 | Douglas |
| 3,139,208 | A | 6/1964 | Irwin et al. |
| 3,182,856 | A | 5/1965 | Goltz |
| 3,194,426 | A | 7/1965 | Brown, Jr. |
| 3,303,965 | A | 2/1967 | Parker et al. |
| 3,341,053 | A | 9/1967 | Keene |
| 3,382,969 | A | 5/1968 | Cerniak |
| 3,554,384 | A | 1/1971 | DeNatale |
| 3,644,008 | A | 2/1972 | Overby |
| D226,846 | S | 5/1973 | Rosenburg |
| 3,905,772 | A | 9/1975 | Hartnett et al. |
| 4,095,698 | A | 6/1978 | Wright |
| 4,253,830 | A | 3/1981 | Kazen et al. |
| 4,348,207 | A | 9/1982 | Cappel |
| D269,702 | S | 7/1983 | Suovaniemi et al. |
| D271,619 | S | 11/1983 | Herrmann |

(Continued)

FOREIGN PATENT DOCUMENTS

| | | |
|---|---|---|
| CA | 2056743 | 5/1992 |

OTHER PUBLICATIONS

"Life Science Lab Tools," USA Scientific, Inc., pp. A 1-A 12, Spring 1999.

(Continued)

*Primary Examiner* — Paul Hyun

(74) *Attorney, Agent, or Firm* — Carr & Ferrell LLP

(57) ABSTRACT

The present application is directed to devices for a latching system. The latching system may comprise first and second interlocking latching mechanisms. The first latching mechanism may be coupled to a front surface of a container and the second latching mechanism may be coupled to a lid for the container. The second latching mechanism may be biased into an interlocking position with the first latching mechanism when the lid is moved to a closed position on the container.

15 Claims, 9 Drawing Sheets

(56) References Cited

U.S. PATENT DOCUMENTS

| | | | | | |
|---|---|---|---|---|---|
| 4,472,357 | A | | 9/1984 | Levy et al. | |
| 4,534,474 | A | | 8/1985 | Ng | |
| 4,639,135 | A | | 1/1987 | Borer et al. | |
| D288,845 | S | | 3/1987 | Borer et al. | |
| 4,648,713 | A | | 3/1987 | Borer et al. | |
| 4,671,405 | A | | 6/1987 | Hagan | |
| 4,671,939 | A | | 6/1987 | Mintz | |
| 4,675,299 | A | | 6/1987 | Witty et al. | |
| 4,713,219 | A | | 12/1987 | Gerken et al. | |
| 4,755,356 | A | | 7/1988 | Robbins et al. | |
| 4,757,894 | A | * | 7/1988 | Schreckenstein | 206/3 |
| 4,880,116 | A | * | 11/1989 | Kos | 206/454 |
| 4,938,369 | A | | 7/1990 | Carilli | |
| 4,948,564 | A | | 8/1990 | Root et al. | |
| 4,971,209 | A | | 11/1990 | Todd | |
| D316,449 | S | | 4/1991 | D'Aquino et al. | |
| 5,005,721 | A | | 4/1991 | Jordan | |
| 5,036,989 | A | | 8/1991 | Carilli | |
| D321,940 | S | | 11/1991 | D'Aquino et al. | |
| D325,638 | S | | 4/1992 | Sloat et al. | |
| 5,110,556 | A | | 5/1992 | Lyman et al. | |
| D332,145 | S | | 12/1992 | Wada et al. | |
| 5,167,336 | A | | 12/1992 | Lajovic | |
| 5,254,314 | A | | 10/1993 | Yu et al. | |
| 5,261,208 | A | | 11/1993 | Lockhart | |
| 5,270,011 | A | | 12/1993 | Altherr | |
| 5,271,515 | A | | 12/1993 | Berkheimer et al. | |
| 5,295,602 | A | * | 3/1994 | Swanson | 220/786 |
| 5,325,966 | A | | 7/1994 | Chang | |
| 5,366,088 | A | | 11/1994 | Hill et al. | |
| 5,423,434 | A | | 6/1995 | Chen | |
| 5,441,702 | A | | 8/1995 | Lemieux et al. | |
| 5,577,779 | A | * | 11/1996 | Dangel | 292/80 |
| 5,588,792 | A | | 12/1996 | Tiso | |
| 5,622,676 | A | * | 4/1997 | Lind | 422/564 |
| 5,642,816 | A | | 7/1997 | Kelly et al. | |
| 5,683,659 | A | | 11/1997 | Hovatter | |
| 5,699,925 | A | | 12/1997 | Petruzzi | |
| 5,722,553 | A | | 3/1998 | Hovatter | |
| 6,019,225 | A | | 2/2000 | Kalmakis et al. | |
| 6,047,827 | A | | 4/2000 | Huang | |
| 6,386,381 | B2 | | 5/2002 | Csiszar | |
| 6,534,015 | B1 | | 3/2003 | Viot et al. | |
| 6,717,771 | B1 | | 4/2004 | Morita et al. | |
| 7,520,396 | B1 | | 4/2009 | Harris | |
| 7,658,887 | B2 | | 2/2010 | Hovatter | |
| 8,087,527 | B2 | | 1/2012 | Johnson | |
| 8,191,718 | B2 | | 6/2012 | Hovatter | |
| 9,022,234 | B2 | | 5/2015 | Hovatter | |
| 2005/0150808 | A1 | | 7/2005 | Sarna et al. | |
| 2006/0045815 | A1 | | 3/2006 | Hovatter | |
| 2006/0049075 | A1 | | 3/2006 | Chen | |
| 2007/0163973 | A1 | | 7/2007 | Smokowicz et al. | |
| 2009/0090647 | A1 | | 4/2009 | Panchal et al. | |
| 2010/0089850 | A1 | | 4/2010 | Hovatter | |
| 2011/0079413 | A1 | | 4/2011 | Masumoto | |
| 2012/0228248 | A1 | | 9/2012 | Hovatter | |
| 2014/0271412 | A1 | | 9/2014 | Hovatter | |

OTHER PUBLICATIONS

"CMS/Fisher HealthCare 98/99," Fisher Scientific, pp. 833, 1998-1999 and pp. 827-830.

Applied Scientific, pp. 72-74, Jul. 1, 1996.

"Eppendorf Products and Applications for the Laboratory 2004," Brinkmann, pp. 38-41, 2004.

"The VWR Scientific Products Catalog," VWR Scintific Products, pp. 1297-1300, 1997-1998.

http://www.heathrowscientific.com/catalog/product?deptId=TUBE+RACKS&prodId=29040A on May 19, 2010.

International Search Report and Written Opinion of the International Searching Authority mailed Sep. 10, 2014, in Application PCT/US2014/021936, filed Mar. 7, 2014.

* cited by examiner

CONTAINER LATCHING SYSTEMS FOR ONE-HANDED OPERATION

FIELD OF THE INVENTION

The present invention is directed generally to containers, and more specifically to latches for containers that allow the container to be opened and closed with one hand.

BACKGROUND

Containers are used in all aspects of society for storing and transporting goods. Containers may range in size from large cargo containers to boxes, cans, and bags that can be easily transported and used by an individual. Since most containers have to be sealed, a wide variety of lids have been developed for the containers. Many containers also include some type of latch mechanism to keep the lid securely attached to the container. While a latch mechanism is useful and often necessary, the ability to quickly and easily open the latching mechanism is necessary and desirable for many applications.

Because of this widespread use, specialty containers have been developed that are adapted for specific needs. The need for specialty containers is particularly evident in a laboratory environment. The need to keep laboratory equipment and supplies free of contamination is vital, and most laboratory supplies are packaged in containers that help prevent contamination. However, the nature of laboratory work often requires a laboratory technician to hold a device or instrument in one hand while obtaining another device or supplies with the other hand. The other device or supplies may be stored in a container to prevent contamination. If the container includes a latching system to secure the lid to the container, the technician may find that opening the container is difficult or impossible with one hand.

SUMMARY

The present application is directed to methods and devices for a latching system that may be opened or closed with one hand. The latching system may comprise first and second interlocking latching mechanisms. The first latching mechanism may be coupled to a front surface of a container by a ledge such that the first latching mechanism is spaced apart from the front surface of the container. A slot may be formed between the first latching mechanism and the front surface of the container. The second latching mechanism may be coupled to a lid for the container. An angled shoulder may be positioned along a top surface of the ledge proximate to where the ledge joins the front surface of the container. The shoulder may bias the second latching mechanism into an interlocking position with the first latching mechanism when the second latching mechanism is inserted into the slot.

DETAILED DESCRIPTION

The present application is directed to methods and devices for a latching system. The latching system may comprise first and second interlocking latching mechanisms. The first latching mechanism may be coupled to a front surface of a container by a ledge such that the first latching mechanism is spaced apart from the front surface of the container. A slot may be formed between the first latching mechanism and the front surface of the container. The second latching mechanism may be coupled to a lid for the container. An angled shoulder may be positioned along a top surface of the ledge proximate to where the ledge joins the front surface of the container. The shoulder may bias the second latching mechanism into an interlocking position with the first latching mechanism when the second latching mechanism is inserted into the slot.

Figure 1:
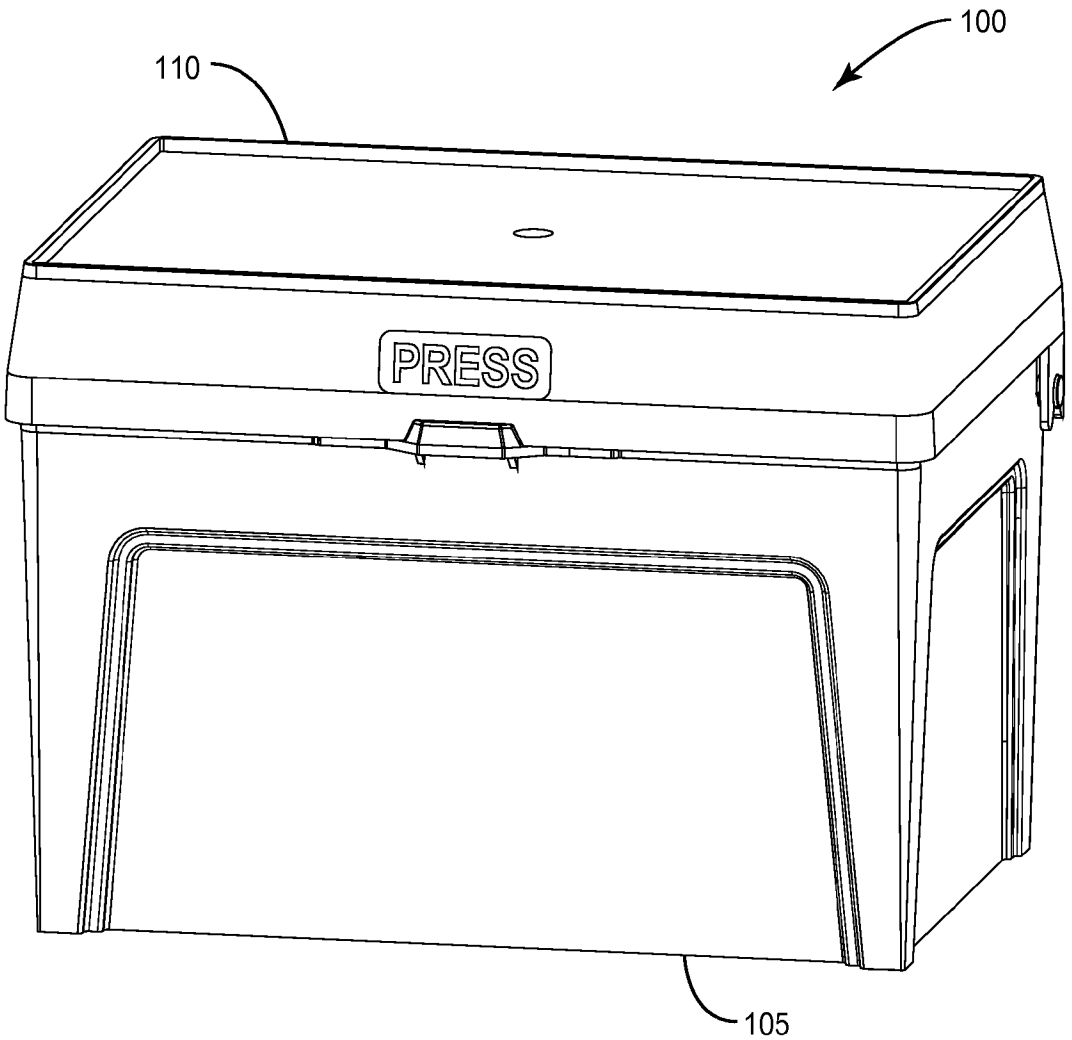
FIG. 1 is a perspective view of a storage system according to various embodiments.
Figure 2:
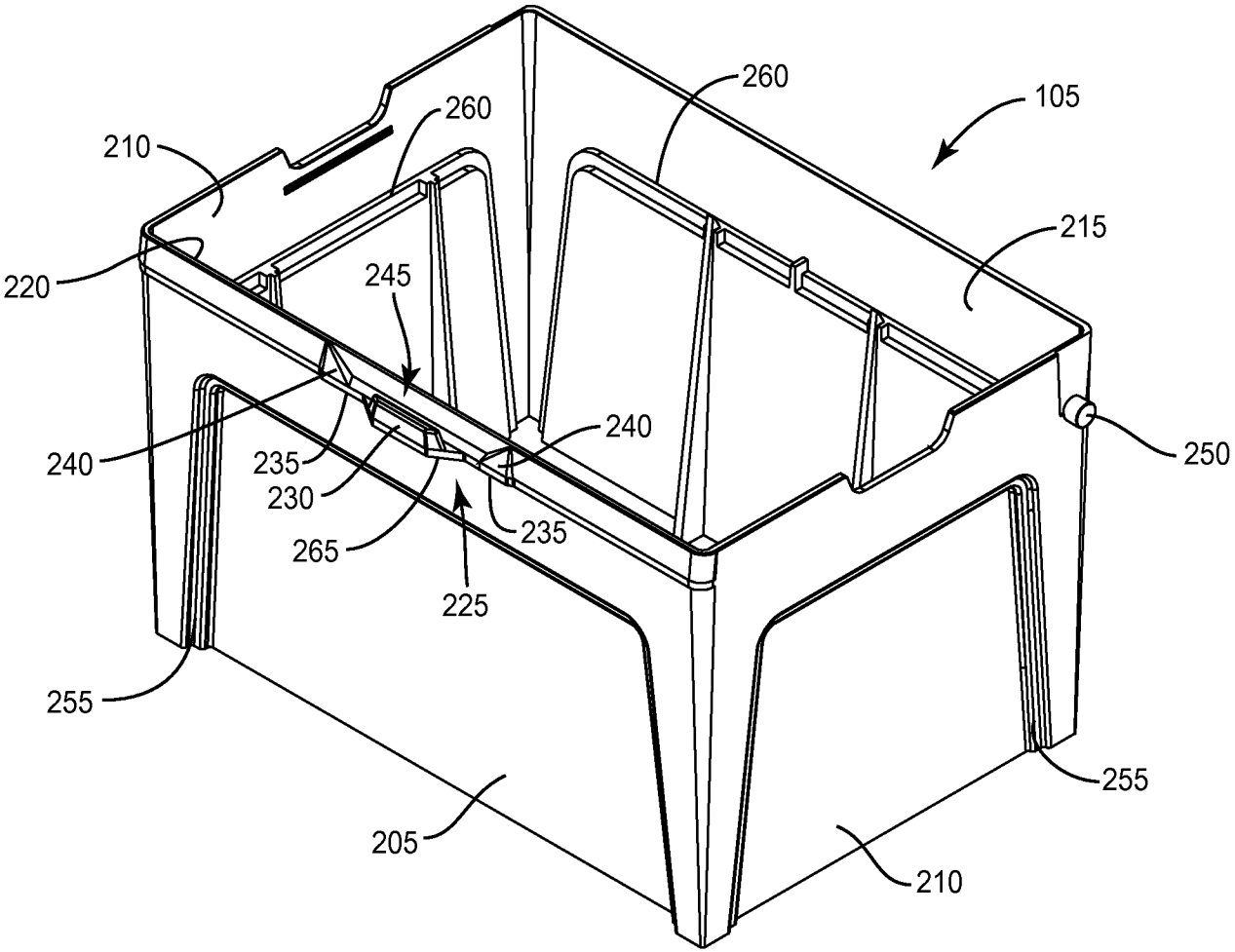
FIG. 2 is a perspective view of a container portion of a storage system according to various embodiments.

FIG. 1 illustrates a storage system 100 according to various embodiments. The storage system 100 may comprise a container 105 which may be adapted to store a variety of items, and a lid 110. The lid 110 may be hingedly attached to the container 105 by any type of hinge that allows free and generally unrestrained pivoting movement of the lid 110 when the lid 110 is opened and closed. For example, as further illustrated in FIGS. 2 and 7, the container 105 may comprise hinge pivot posts 250 extending from front wall 205. The lid 110 may comprise hinge post receivers 720 that correspond to each hinge pivot post 250 and which may be adapted to press fit over the hinge pivot posts 250. Although not shown in the figures, the hinge pivot posts 250 may alternatively extend from the lid 110 to facilitate coupling the lid 110 to the container 105.

Returning to FIG. 2, various embodiments of the container 105 may comprise a front wall 205, left and right side walls 210, and back wall 215. The front wall 205 may comprise an upper lip 220 along an edge of the front wall 205. A lower latch assembly 225 may be positioned on the front wall 205 below the upper lip 220. The lower latch assembly 225 may comprise a ledge 235, a ledge extension 265, a first interlocking latching mechanism 230, and one or more shoulders 240 extending from the ledge 235 towards the upper lip 220. The first latching mechanism 230 may be spaced apart from the front wall 205 forming a gap or slot 245 therebetween. The lower latch assembly 225 and its functions are further described below in relation to FIGS. 6 and 9.

One or more of the front wall 205, side walls 210 and back wall 215 may comprise wall indentations 255 that form one or more support shelves 260 within the interior of the container 105. The support shelves 260 may function to hold a tray (not shown) in place when the tray is inserted into the container 105. For example, the container 105 may be adapted to store a plurality of pipette tips that are contained by a tray that may be inserted into the container 105 such that the tray rests on one or more of the support shelves 260.

Figure 3:
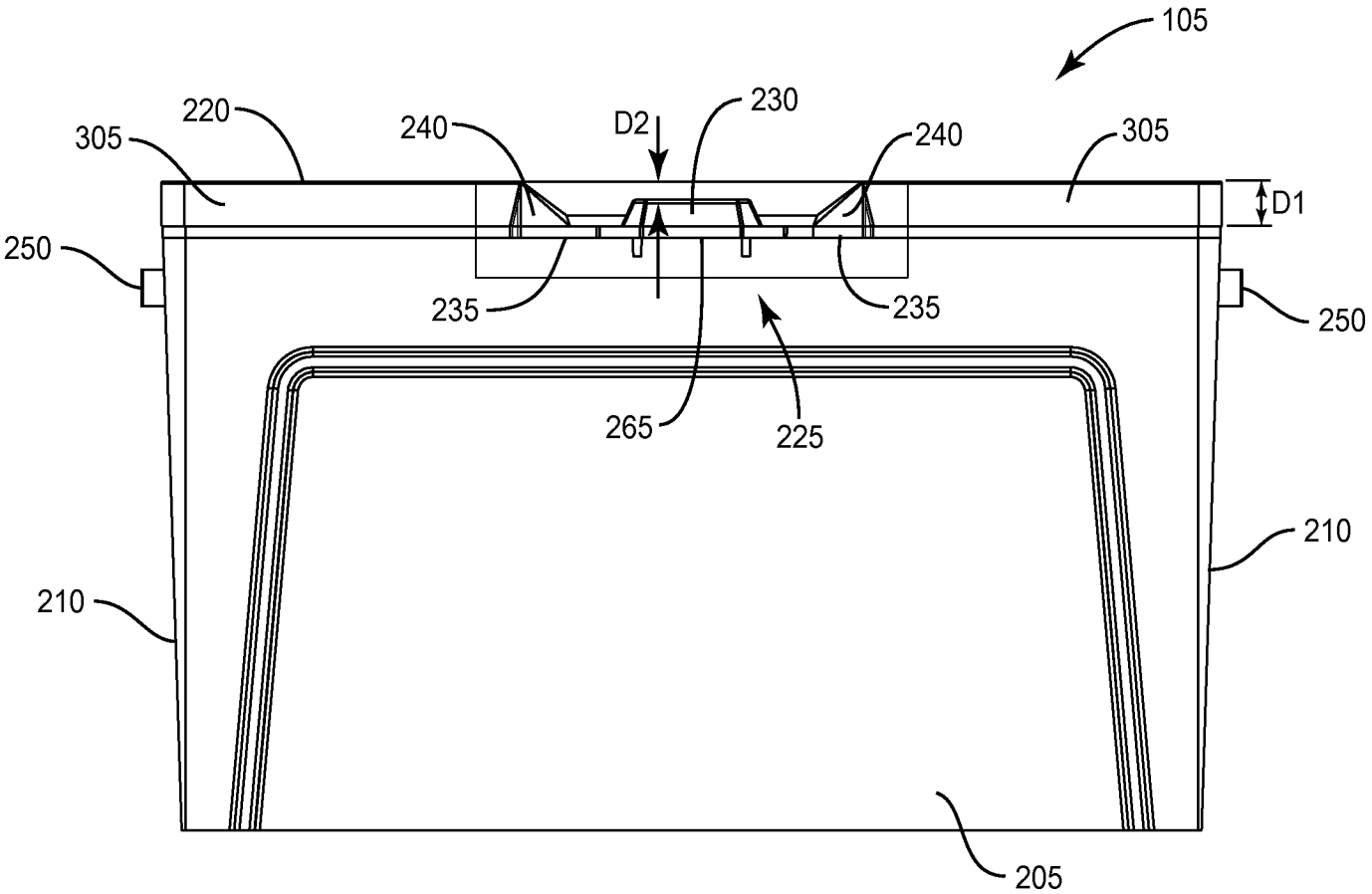
FIG. 3 is a front view of a container portion of a storage system according to various embodiments.

A front view of the container 105 is illustrated in FIG. 3 to provide further detail on the positioning of the lower latch assembly 225 on the front wall 205 according to various embodiments. The ledge 235 and the ledge extension 265 may be positioned a distance D1 from the upper lip 220 of the front wall 205. The distance D1 may be approximately equal to an amount that the lid 110 overlaps an upper rim 305 of the container 105 such that a lower lip 740 of the lid 110 (see FIG. 7) either contacts or comes in close proximity to a top surface 910 on the ledge 235 (see FIG. 9) when the lid 110 is in a closed position on the container 105. The ledge 235 may extend directly outward from the front wall 205 such that the ledge 235 is oriented essentially perpendicular to the front wall 205. The ledge extension 265 may further extend all or a portion of the ledge 235 outward from the front wall 205. The first latching mechanism 230 may extend upward from an edge of the ledge extension 265 opposite where the ledge 235 is coupled to the front wall 205 so that the first latching mechanism 230 is spaced apart a distance D3 (see FIG. 9) from the front wall 205, such that the first latching mechanism 230 may be oriented generally parallel to the front wall 205. The distance D3 may correspond to a width of the slot 245 and may be greater than a thickness of a front wall 705 (see FIG. 7) of the lid 110 such that the front wall 705 may fit within the slot 245 when the lid 110 is moved to a closed position. A top edge of the first latching mechanism 230 may be spaced a distance D2 from the upper lip 220 of the front wall 205. In certain embodiments, the distance D2 may be zero, meaning that the top edge of the first latching mechanism 230 extends up to the upper lip 220. In other embodiments, the distance D2 is greater than zero which may provide clearance so that the lower lip 740 of the lid 110 does not contact the first latching mechanism 230 when the lid 110 is being moved to the closed position.

Further, the lower latch assembly 225 may comprise one or more shoulders 240. Each shoulder 240 may extend from the ledge 235 to the upper lip 220 of the front wall 205. Each shoulder 240 may have a tapered shape with a widest point of the shoulder 240 positioned at the ledge 235 and a narrowest portion point of the shoulder 240 positioned at the upper lip 220. According to various embodiments, the lower latch assembly 225 may comprise more than one shoulders 240 as illustrated in FIG. 3, or may comprise a single shoulder 240. The single shoulder 240 may be positioned directly behind the first latching mechanism 230 as viewed in FIG. 3. It should be noted that while FIG. 3 illustrates two shoulders 240 positioned to either side of the first latching mechanism 230 as viewed in FIG. 3, one skilled in the art will readily recognize that any number of shoulders 240 may be placed at any position along the ledge 235. Additionally, while FIG. 3 illustrates that the shoulders 240 extend to the upper lip 220, in various embodiments the shoulders 240 may end some distance short of the upper lip 220.

Figure 4:
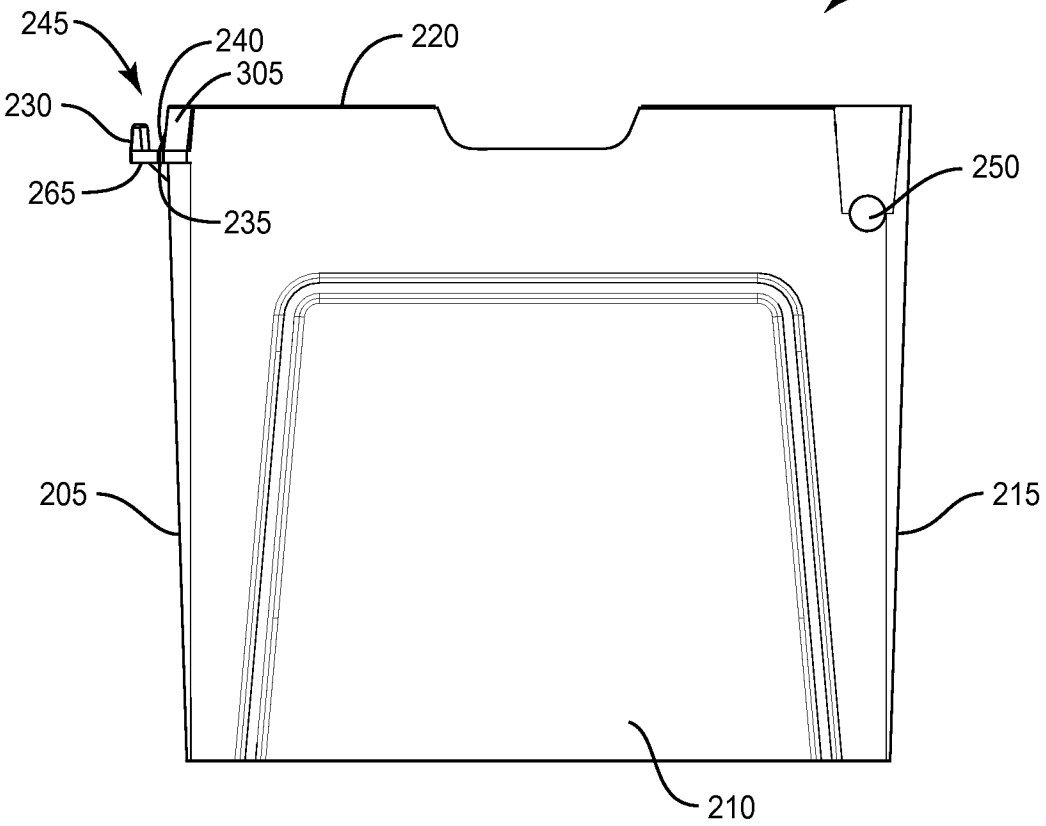
FIG. 4 is a side view of a container portion of a storage system according to various embodiments.
Figure 5:
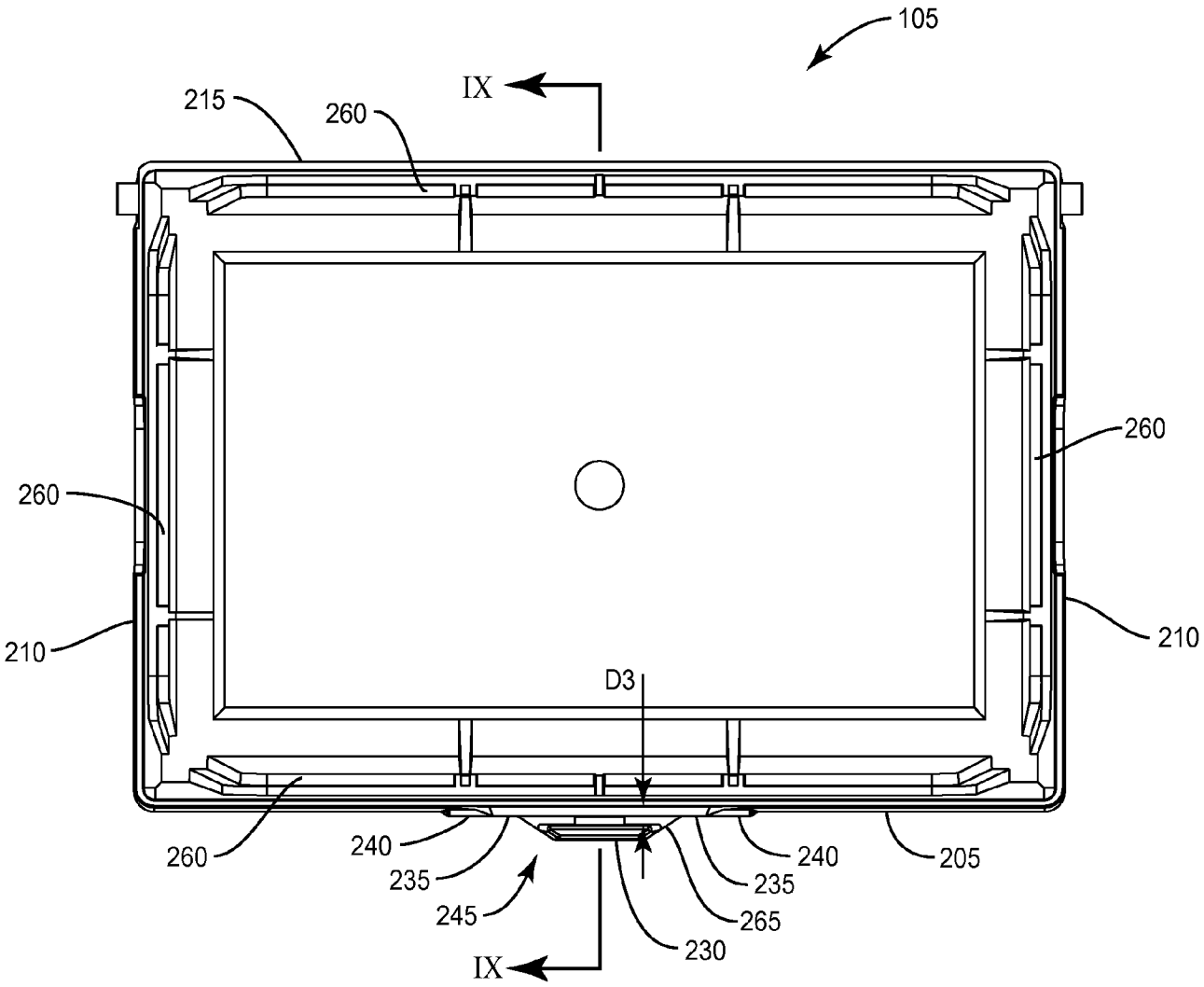
FIG. 5 is a top view of a container portion of a storage system according to various embodiments.

FIG. 4 illustrates a side view and FIG. 5 illustrates a top view of the container 105 according to various embodiments. In these views, the spacing apart of the first latching mechanism 230 and the upper rim 305 of the container 105 forming the slot 245 therebetween may be more distinctly visible. FIG. 4 also illustrates the positioning of the shoulders 240 on the ledge 235 such that the distance D3, which is the width of the slot 245, is effectively reduced by a thickness of the shoulders 240. The ledge 235 may have a width (measured outward from the front wall 205 approximately equal to the widest portion of the shoulders 240. The ledge extension 265 may extend further beyond the ledge 235 and may support the first latching mechanism 230.

Figure 6:
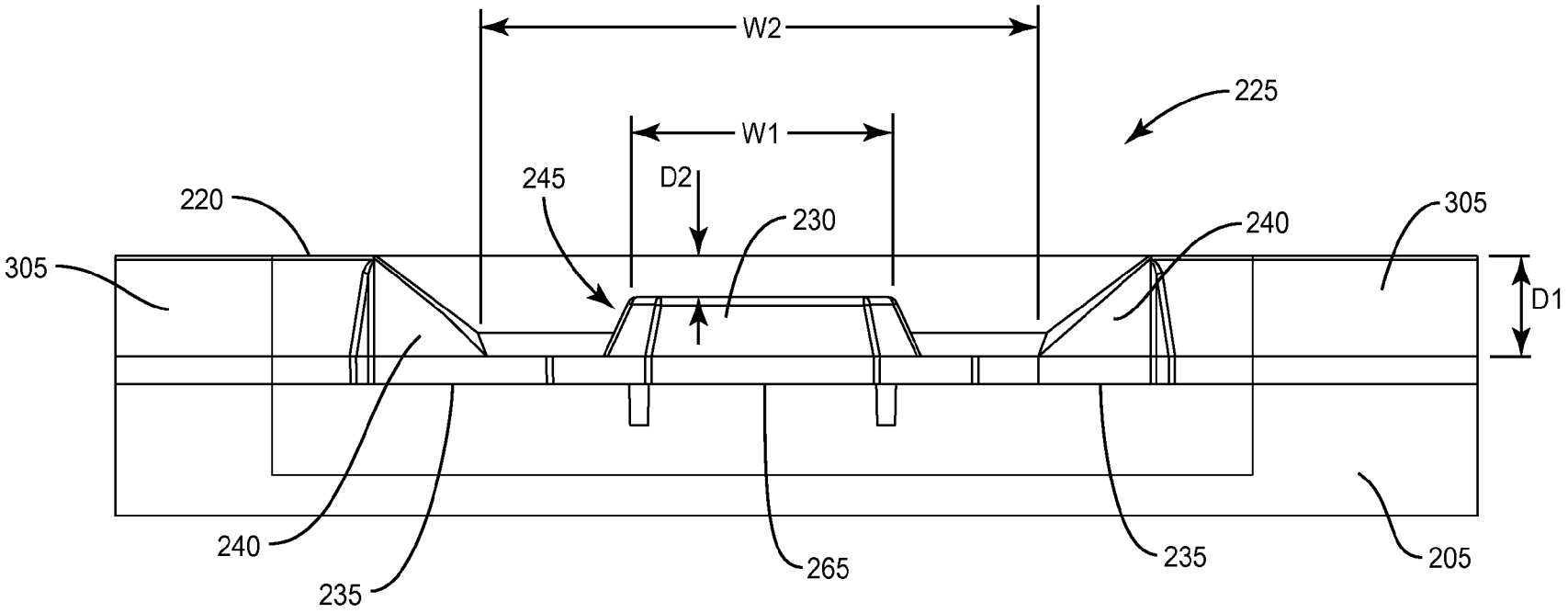
FIG. 6 is front detail view of a latching system for a storage system according to various embodiments.

FIG. 6 illustrates a front detail view of the lower latch assembly 225 according to various embodiments. As discussed previously, the ledge 235 and ledge extension 265 are spaced a distance D1 from the upper lip 220 to allow the front wall 705 to overlap the upper rim 305 of the container 105. In various embodiments, the first latching mechanism 230 may have a width W1 extending across the ledge extension 265 that is less than a distance W2 between the shoulders 240. In certain other embodiments, the width W1 of the first latching mechanism 230 may be equal to or greater than the distance W2 between the shoulders. A force required to open the storage system 100 may increase as W1 approaches W2. That is, as the shoulders 240 move closer together and are positioned between the first latching mechanism 230 and the upper rim 305, the force required to open the storage system 100 may increase. Conversely, the farther the shoulders 240 are positioned away from the first latching mechanism 230 (as depicted in FIG. 6, for example) the smaller the force becomes that may be required to open the storage system 100.

Figure 7:
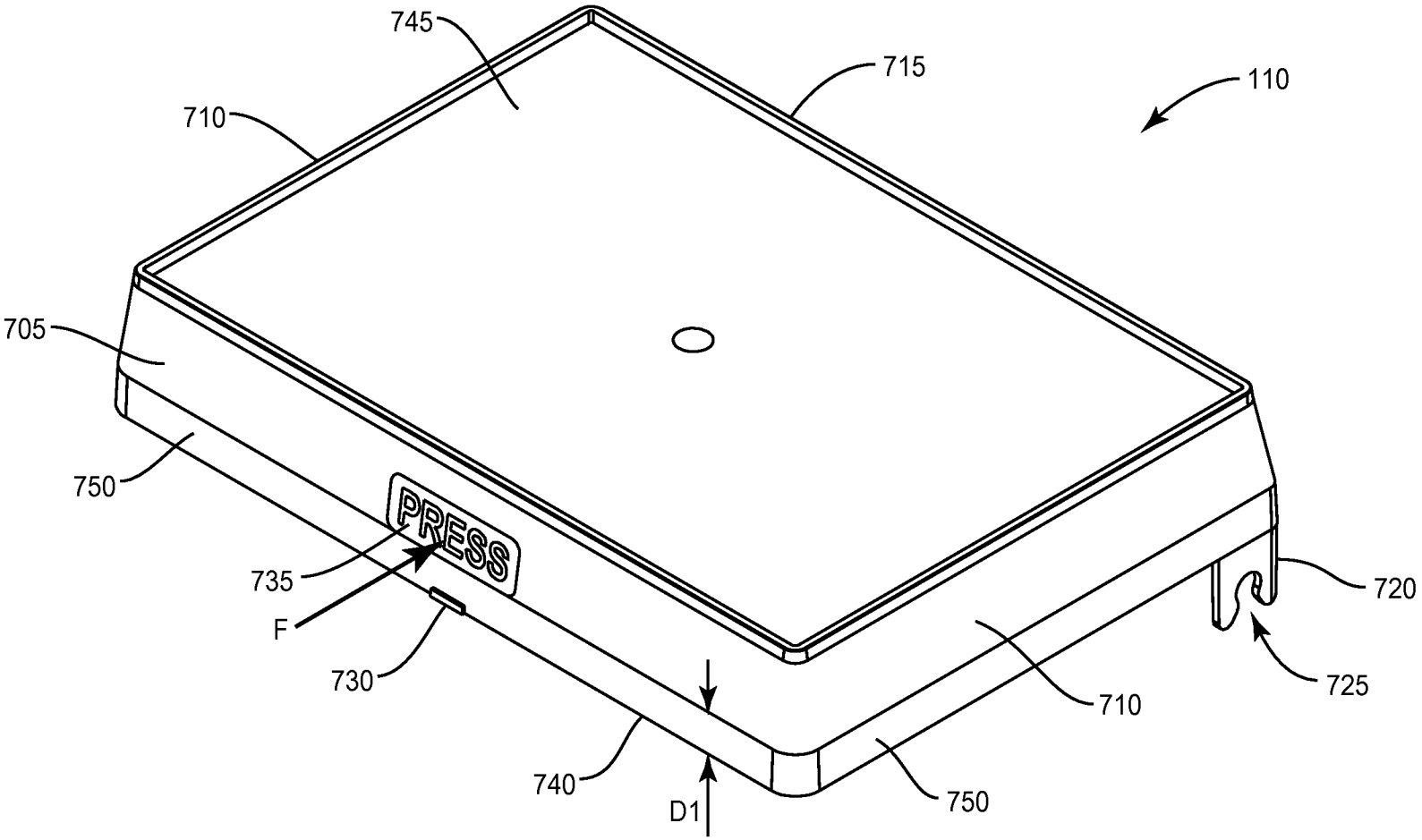
FIG. 7 is a perspective view of a lid portion of a container system according to various embodiments.
Figure 8:
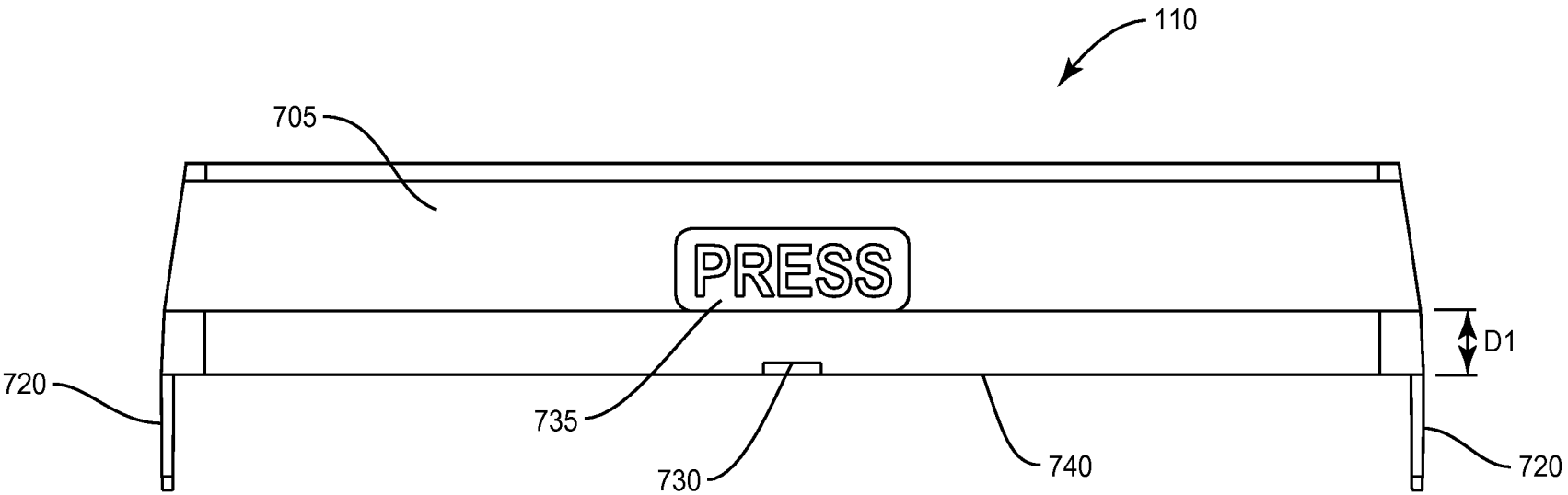
FIG. 8 is a front view of a lid portion of a storage system according to various embodiments.

Various embodiments of the lid 110 are illustrated in FIGS. 7 and 8. The lid 110 may comprise a top wall 745 with front wall 705, side walls 710 and rear wall 715 extending downwardly from the top wall 745. The hinge post receivers 720 may extend downwardly from a lower edge of the side walls 710 in proximity to where the side walls 710 and the rear wall 715 meet. The hinge post receivers 720 may further comprise a hinge post receiving slot 725 that may allow the hinge post receiver 720 to be snapped in place over the hinge pivot posts 250. A lower portion of the front wall 705, side walls 710, and rear wall 715 may form a lower rim 750 of the lid 110, terminating at the lower lip 740. The lower rim 750 of the lid 110 may overlap the upper rim 305 of the container 105 when the lid 110 is in the closed position.

A second interlocking latching mechanism 730 may be positioned on the lower rim 750 at the lower lip 740 of the front wall 705. The second latching mechanism 730 may be positioned such that it is in a centered alignment with the first latching mechanism 230 when the lid 110 is in a closed position (see FIG. 1). The lid may be constructed of a material that while resilient will elastically yield when a force is applied. For example, a force F may be applied in the direction of the arrow in FIG. 7 to an area 735 on the front wall 705 of the lid 110 in proximity to the second latching mechanism 730. The force F may cause the front wall 705 to arch inwardly. When the force F is applied to the front wall 705 when the lid 110 is in the closed position, the resulting arching of the front wall 705 may cause the second latching mechanism 730 to move inwardly relative to the first latching mechanism 230.

Figure 9:
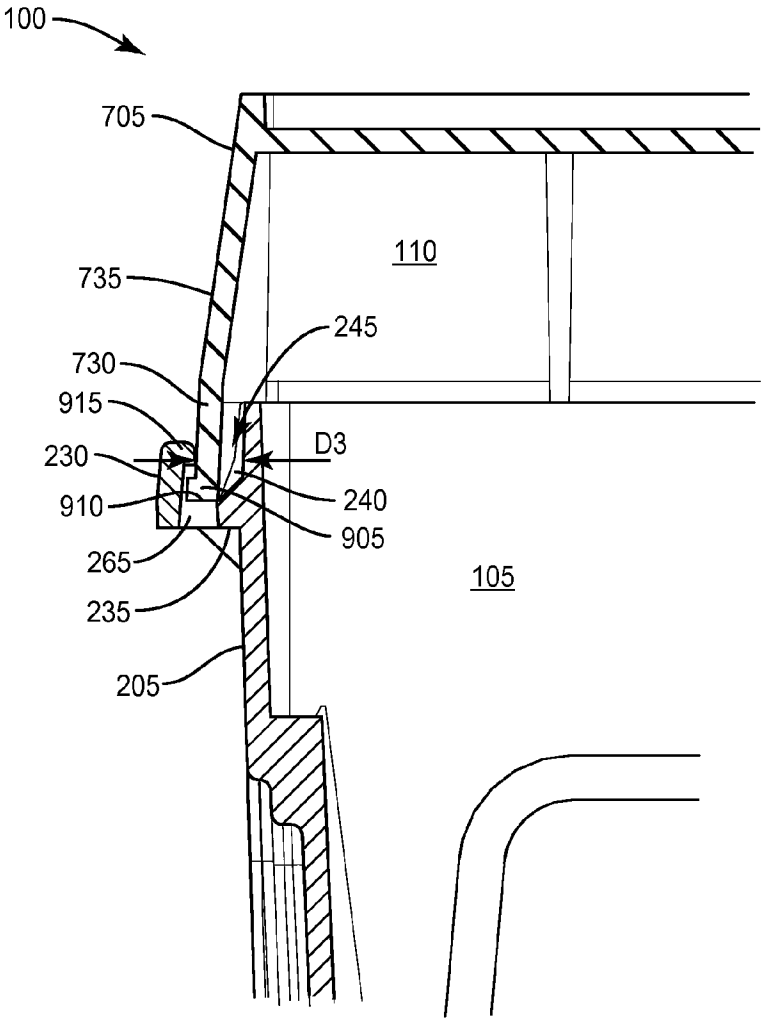
FIG. 9 is a cross-sectional view of a latching mechanism for a storage system according to various embodiments.

FIG. 9 illustrates a cross-sectional view of the storage system 100 with the lid 110 in a closed position along the plane indicated in FIG. 5. The ledge 235 may extend outwardly from the front wall 205 of the container 105 such that the ledge 235 is essentially perpendicular to the front wall 205. The ledge extension 265 extends at least a portion of the ledge 235 further out from the front wall 205. A top surface 910 of the ledge 235 and ledge extension 265 may comprise a seating surface for the second latching mechanism 730 when the lid 110 is in the closed position as illustrated in FIG. 9. The shoulders 240 may be positioned on the ledge 235, extending upwardly towards the upper lip 220 of the container 105. The shoulders 240 may taper, having the greatest thickness at the ledge 235. Extending upwardly from the ledge extension 265, the first latching mechanism 230 may form the slot 245 between the latching mechanism 230 and the front wall 205 of the container 105. The first latching mechanism 230 may be oriented generally perpendicular to the ledge extension 265 and parallel to the front wall 205. The first latching mechanism 230 may terminate in a first interlocking leg 915 oriented generally perpendicular to the first latching mechanism 230 and extending towards or into the slot 245. The first latching mechanism 230 and the first interlocking leg 915 may form an inverted L-shape as viewed in FIG. 9. Additionally, an end surface of the first interlocking leg 915 may be beveled to urge the second latching mechanism 730 into the slot 245 when the lid 110 is moved toward the closed position.

The front wall 705 of the lid 110 may comprise the second latching mechanism 730. The second latching mechanism 730 may terminate in a second interlocking leg 905 oriented generally perpendicular to the second latching mechanism 730 and extending away from the slot 245. The second latching mechanism 730 and the second interlocking leg 905 may form a reverse L-shape as viewed in FIG. 9. When the lid 110 is in the closed position, the first interlocking leg 915 and the second interlocking leg 905 overlap one another and prevent the lid 110 from opening when the lid 110 is in the closed position.

Access to articles stored in receptacles can be difficult or cumbersome, particularly when a user has only one hand free to open the receptacle. This may happen in a laboratory environment when a lab technician is performing an analysis involving a pipette. The technician may be holding the pipette in one hand and may require access to pipette tips stored in a receptacle. The technician may, while holding the pipette in one hand, try to use his free hand to open a receptacle storing the pipette tips. Unless the receptacle is adapted for one-hand operation, opening the receptacle may prove to be difficult or impossible. In a laboratory setting, dealing with a receptacle that requires both hands to open (and close) when only one hand is free may pose significant dangers to the technician. The present disclosure may describe a latching system and receptacle that is adapted for one-handed use.

Referring again to FIG. 9, the one-handed operation of the latching system will be described. The technician in the above example may place the thumb of his free hand on the area 735 of the front wall 705 of the lid 110. This may allow the technician to place the other four fingers of the free hand on the top wall 745 of the lid 110. In this position one or more of the other four fingers may be positioned towards a back edge of the top wall 745 and behind a centerline of the lid 110 running from side wall 710 to side wall 710. The technician may then apply pressure (e.g., force F as depicted in FIG. 7) to the area 735 on the front wall 705 of the lid 110 with his thumb. The force F may cause the front wall 705 of the lid 110 to slightly arch inward. This movement of the front wall 705 may cause the second interlocking leg 905 to disengage from the first interlocking leg 915. As the front wall 705 continues to arch inward, the second latching mechanism 730 may contact one or more of the shoulders 240. Because the shoulders 240 are tapered, the angle of the shoulders 240 may urge the second latching mechanism 730 (and hence, the lid 110) upwardly, allowing the now disengaged second interlocking leg 905 to clear the first interlocking leg 915. While continuing to apply pressure with his thumb, the technician may rotate his hand while applying pressure to the top wall 745 of the lid 110 with the other fingers. The pressure exerted on the top wall 745 may prevent the container 105 from lifting up when the lid 110 is opened. Additionally, pressure applied to the top wall 745 by the fingers behind the centerline of the lid 110 may facilitate the pivoting action of the lid 110 on the hinge pivot posts 250.

Similarly, the lid 110 may be closed using one hand. From an open position, the technician may grasp the lid 110 as described above with the thumb resting on the front wall 705 and the other fingers on the top wall 745; however, the thumb does not necessarily need to apply enough force to arch the front wall 705 inward. As the lid 110 is rotated towards a closed position and the second latching mechanism 730 enters the slot 245, the second latching mechanism 730 may contact one or more of the shoulders 240. The tapered shape of the shoulders 240 may urge the second latching mechanism 730 towards the first latching mechanism 230, causing the first interlocking leg 915 and the second interlocking leg 905 to overlap and lock the lid 110 in the closed position.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A latching system, comprising:

a first latching mechanism coupled to a front wall of a container by a ledge, such that the first latching mechanism is spaced apart from the front wall of the container forming a slot therebetween, the first latching mechanism oriented generally perpendicular to the ledge and parallel to the front wall of the container, the first latching mechanism connected to a first interlocking leg oriented generally parallel to the ledge and perpendicular to the front wall of the container, the first latching mechanism and the first interlocking leg forming an inverted L-shape;

a second latching mechanism coupled to a lid for the container, an end surface of the first interlocking leg beveled to urge the second latching mechanism into the slot as the lid is moved to a closed position; and at least two tapered shoulders positioned along a top surface of the ledge proximate to where the ledge joins the front wall of the container, such that the shoulders bias the second latching mechanism into an interlocking position with the first latching mechanism when the second latching mechanism is inserted into the slot, the shoulders separated by a fixed distance such that the distance between the shoulders affects a magnitude of a force required to disengage the first and second latching mechanisms.

2. A latching system, comprising:

a ledge extending outwardly from a front wall of a container;

at least two tapered shoulders extending from a top surface of the ledge to the front wall of the container;

a first latching mechanism extending upwardly from an end of the ledge opposite the front wall of the container, the first latching mechanism having an inverted L-shape and forming a slot between the first latching mechanism and the front wall of the container; and a second latching mechanism extending downwardly from a front wall of a lid hingedly coupled to the container, the second latching mechanism having a reverse L-shape such that when the lid is moved to a closed position the second latching mechanism enters the slot and contacts the shoulders, the shoulders biasing the second latching mechanism into an interlocking position with the first latching mechanism and separated by a fixed distance such that the distance between the shoulders affects a magnitude of a force required to disengage the first and second latching mechanisms.

3. The latching system of claim 2, wherein the first latching mechanism comprises a first interlocking leg and the second latching mechanism comprises a second interlocking leg, wherein the first and second interlocking legs are oriented generally parallel to the ledge and perpendicular to the front wall of the container when the first and second latching mechanisms are in the interlocking position.

4. The latching system of claim 2, wherein one of the at least two tapered shoulders defines a seating surface on the ledge.

5. The latching system of claim 3, wherein at least one of a front wall of the lid and the second latching mechanism is pliable such that a sufficient force applied to the front wall of the lid in proximity to the second latching mechanism causes the second latching mechanism to contact the shoulder, thereby urging the second latching mechanism upward in the slot and allowing the lid to be moved to an open position.

6. The latching system of claim 3, wherein a width of the slot is greater than a length of the second interlocking leg.

7. The latching system of claim 3, wherein an end surface of the first interlocking leg is beveled to urge the second latching mechanism into the slot as the lid is moved to a closed position.

8. The latching system of claim 2, wherein a front wall of the lid biases the second latching mechanism toward the first latching mechanism when the lid is in a closed position.

9. The latching system of claim 2, wherein the container is adapted to store pipette tips.

10. A receptacle for storing pipette tips, comprising:

a container portion, comprising:

a front wall;

a ledge extending outwardly from the front wall of the container portion;

at least two beveled shoulders extending from a top surface of the ledge to the front wall of the container portion;

a first latching mechanism extending upwardly from an end of the ledge opposite the front wall of the container portion, the first latching mechanism having an inverted L-shape and forming a slot between the first latching mechanism and the front wall of the container portion; and a lid portion hingedly coupled to the container portion, comprising:

a front wall;

a second latching mechanism extending outwardly from the front wall of the lid portion, the second latching mechanism having a reverse L-shape such that when the lid portion is moved to a closed position on the container portion the second latching mechanism enters the slot and contacts the shoulders, the shoulders biasing the second latching mechanism into an interlocking position with the first latching mechanism and separated by a fixed distance such that the distance between the shoulders affects a magnitude of a force required to disengage the first and second latching mechanisms.

11. The receptacle of claim 10, wherein the first latching mechanism comprises a first interlocking leg and the second latching mechanism comprises a second interlocking leg, the first and second interlocking legs each oriented generally parallel to the ledge and perpendicular to the front wall of the container portion when the first and second latching mechanisms are in the interlocking position.

12. The receptacle of claim 11, wherein at least one of a front wall of the lid portion and the second latching mechanism is pliable such that a sufficient force applied to the front wall of the lid portion in proximity to the second latching mechanism causes the second latching mechanism to contact one of the at least two beveled shoulders, thereby urging the second latching mechanism upward in the slot and allowing the lid portion to be moved to an open position.

13. The receptacle of claim 11, wherein a width of the slot is greater than a length of the second interlocking leg.

14. The receptacle of claim 11, wherein an end surface of the first interlocking leg is beveled to urge the second latching mechanism into the slot as the lid portion is moved to a closed position.

15. The receptacle of claim 11, further comprising a removable tray for holding the pipette tips positioned within the container portion.

* * * * *